US009251928B2

(12) United States Patent
Taniguchi

(10) Patent No.: US 9,251,928 B2
(45) Date of Patent: Feb. 2, 2016

(54) FLEXIBLE CABLE

(71) Applicant: Naoki Taniguchi, Osaka (JP)

(72) Inventor: Naoki Taniguchi, Osaka (JP)

(73) Assignee: TAIYO CABLETEC CORPORATION (JP)

( * ) Notice: Subject to any disclaimer, the term of this patent is extended or adjusted under 35 U.S.C. 154(b) by 168 days.

(21) Appl. No.: 14/084,354

(22) Filed: Nov. 19, 2013

(65) Prior Publication Data

US 2014/0069688 A1 Mar. 13, 2014

Related U.S. Application Data

(63) Continuation of application No. PCT/JP2012/057901, filed on Mar. 27, 2012.

(30) Foreign Application Priority Data

Jan. 25, 2012 (JP) ..... 2012-012921

(51) Int. Cl.

| | |
|---|---|
| ***H01B 7/04*** | (2006.01) |
| ***H01B 7/00*** | (2006.01) |
| ***C22C 9/00*** | (2006.01) |
| *H01B 13/02* | (2006.01) |

(52) U.S. Cl.

CPC .. *H01B 7/04* (2013.01); *C22C 9/00* (2013.01); *H01B 7/0009* (2013.01); *H01B 13/02* (2013.01)

(58) Field of Classification Search

CPC ..... G02B 6/44; H01B 11/18; H01B 11/02; H01B 15/00; H01B 7/04; H01B 7/00; H01B 7/0009; H01B 5/02; H01B 5/08; H01B 5/10; H01B 7/08; H01B 7/42; H01B 7/14; H01B 7/17; H01B 7/18; H01B 7/22; H01B 9/02; H01B 11/00; H01B 13/02; B60R 16/02

USPC ..... 174/102, 113, 108, 126.1, 126.2, 128.1, 174/128.2, 113 R, 102 R, 106 R; 385/101; 57/231, 234

See application file for complete search history.

(56) References Cited

U.S. PATENT DOCUMENTS

| | | | | |
|---|---|---|---|---|
| 3,865,971 A * | 2/1975 | Kumagai | ..... | H01B 1/00 174/102 R |
| 6,303,868 B1 | 10/2001 | Kawai | | |
| 2009/0178825 A1 * | 7/2009 | Wu et al. | ..... | 174/113 R |

FOREIGN PATENT DOCUMENTS

| | | | |
|---|---|---|---|
| CN | 202422790 U | * | 9/2012 |
| CN | 203150247 U | * | 8/2013 |
| JP | S58106813 U | | 7/1983 |

(Continued)

OTHER PUBLICATIONS

International Search Report Application No. PCT/JP2012/057901 Completed: Apr. 17, 2012; Mailing Date: May 1, 2012 2 pages.

*Primary Examiner* — Timothy Thompson
*Assistant Examiner* — Guillermo Egoavil
(74) *Attorney, Agent, or Firm* — St. Onge Steward Johnston & Reens LLC

(57) ABSTRACT

A flexible cable has a conductor formed by twisting a plurality of annealed copper wires and a plurality of alloy wires, an assembled conductor formed by twisting a plurality of the conductors, an insulated wire core formed by covering the assembled conductor with an insulator, a cable core portion formed by twisting a plurality of the insulated wire cores, and a sheath covering the outside of a single or a plurality of the cable core portions.

5 Claims, 3 Drawing Sheets

(56) References Cited

FOREIGN PATENT DOCUMENTS

| | | | | | |
|---|---|---|---|---|---|
| JP | 02098012 | A | * | 4/1990 | ..... H01B 7/04 |
| JP | H0298009 | A | | 4/1990 | |
| JP | H06176626 | A | | 6/1994 | |
| JP | 2000228116 | A | | 8/2000 | |
| JP | 2003031031 | A | | 1/2003 | |
| JP | 2007305479 | A | * | 11/2007 | |
| JP | 2008034341 | A | | 2/2008 | |

* cited by examiner

FLEXIBLE CABLE

FIELD OF THE INVENTION

The present invention pertains to the field of cables, and, in particular, to flexible electrical cables suitable for connection to moving parts of various apparatus such as industrial robots, electrical machinery and a wide variety of automatic assembling or automatic processing lines.

BACKGROUND OF THE INVENTION

The cable as shown in Japanese Published Unexamined Patent Application No. H06-176626 is known as a conventional flexible cable. The cable is composed of a conductor formed by twisting annealed copper wires, an insulator, and a sheath. A conductive metallic thin film is formed on an inner surface of the sheath. However, while the cable is generally durable against breaking of the conductor, the cable is too rigid because of the emphasis on durability. Thus, flexibility is at a disadvantage.

SUMMARY OF THE INVENTION

The present invention provides an electric cable that is superior in durability and flexibility.

It is noted that reference signs in parentheses are reference numerals of an embodiment described later, and the present invention should not be limited thereto.

A flexible cable according to an embodiment of the invention is characterized by a conductor (23) formed by twisting a plurality of annealed copper wires (23*a*) and a plurality of alloy wires (23*b*), an assembled conductor (21) formed by twisting a plurality of the conductors (23), an insulated wire core (20) formed by covering the assembled conductor (21) with an insulator (22), a cable core portion (2) formed by twisting a plurality of the insulated wire cores (20), and a sheath (4, 51) covering the outside of a single or a plurality of the cable core portions (2).

Further, a flexible cable according to another embodiment is characterized in that the alloy wire (23*b*) is a copper alloy wire, and a mixing proportion of the copper alloy wire in the conductor (23) is 10 to 70% in the flexible cable.

The effects of the present invention will be described with reference signs attached in the drawings. First, according to an embodiment of the invention, the conductor (23) is formed by twisting a plurality of alloy wires (23*b*) as reinforcing wires with a plurality of annealed copper wires (23*a*), and the conductor (23) is multi-twisted to form the assembled conductor (21). The assembled conductor (21) is covered with the insulator (22) to form the insulated wire core (20). The insulated wire core (20) is multi-twisted to form the cable core portion (2). Therefore, a flexible cable superior in durability and flexibility can be provided.

Further, according to an embodiment of the invention, a flexible cable superior in durability and flexibility can be provided, and also conductivity resistant to use can be secured. Further, durability is lowered if the mixing proportion of the alloy wire (23*b*) composed of the copper alloy wire in the conductor (23) is less than 10%, and conductivity resistant to use cannot be secured if the mixing proportion of the alloy wire (23*b*) composed of the copper alloy wire in the conductor (23) exceeds 70%.

DETAILED DESCRIPTION OF THE INVENTION

Figure 1:
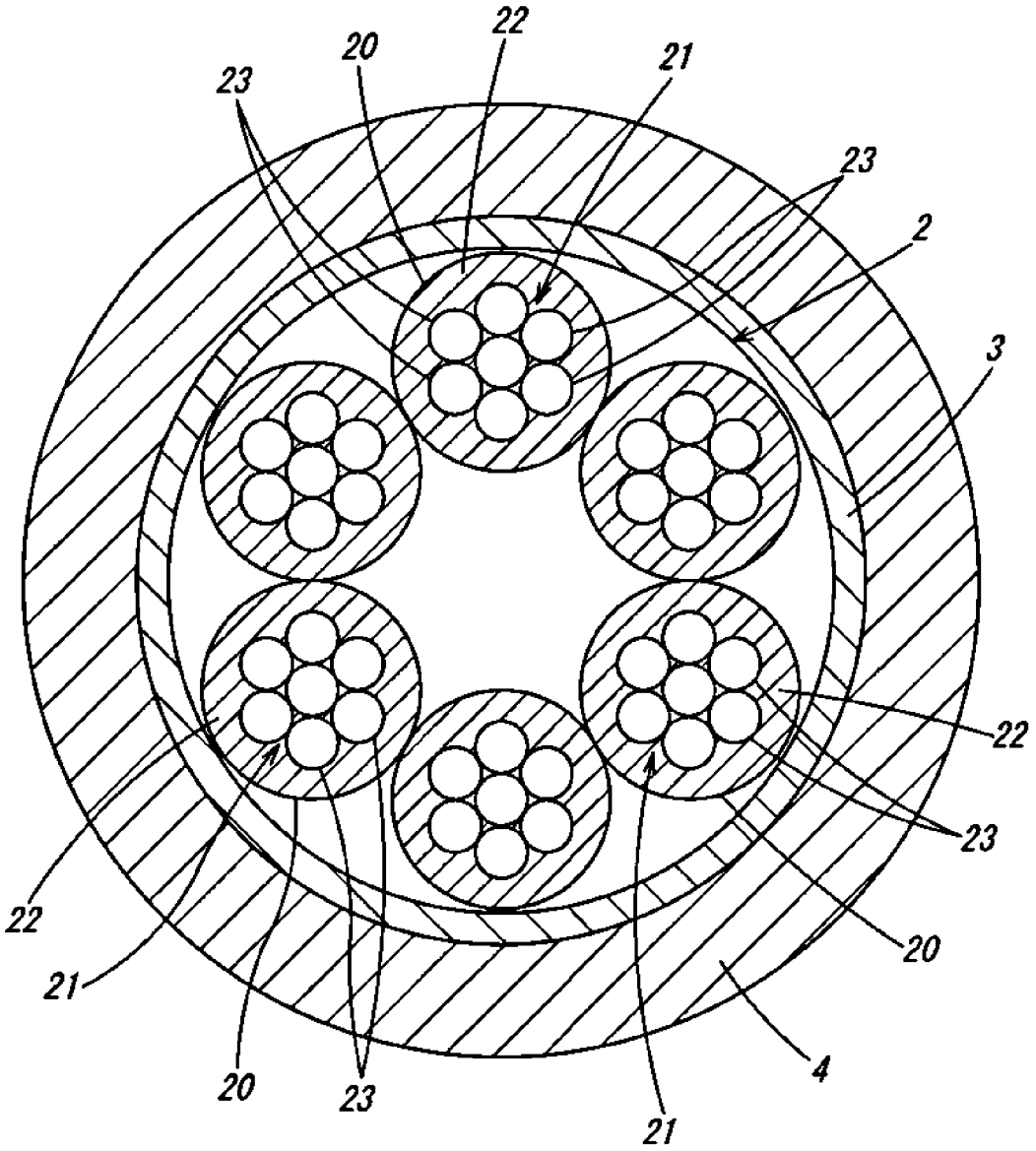
FIG. 1 is a sectional view of a flexible cable according to an embodiment of the present invention.

Hereinafter, an embodiment of a flexible cable according to the present invention will be described in detail with reference to FIGS. 1 and 2. As shown in FIG. 1, a flexible cable 1 according to the present embodiment is formed in a circular shape by covering the outside of a cable core portion 2 with a sheath 4 made of flexible vinyl or urethane materials via a static electromagnetic shielding layer 3 composed of a tinned annealed copper wire braid etc.

The foregoing cable core portion 2 is formed by twisting a plurality of insulated wire cores 20 (six cores in the drawing) as shown in FIG. 1. The insulated wire core 20 is formed by covering an assembled conductor 21 with an insulator 22 as shown in FIG. 1. Further, the insulator 22 is made of non-rigid or semi-rigid polyvinyl chloride, Teflon (registered mark), cross-linked polyethylene, etc.

The foregoing insulated wire core 20 will be described in more detail using FIG. 2. As shown in FIG. 1 and FIG. 2, the insulated wire core 20 is formed by covering the assembled conductor 21 having been formed by twisting a plurality of conductors 23 (seven conductors in the drawings) with the insulator 22. As shown in FIG. 2, the conductor 23 is formed by twisting a plurality of alloy wires 23*b* (four wires in the drawing) as reinforcing wires with a plurality of annealed copper wires 23*a* (14 wires in the drawing). Any type of alloy wires 23*b* may be used, but copper alloy wires are preferable. It is also noted that the plurality of annealed copper wires 23*a* and the plurality of alloy wires 23*b* are shown only in one conductor 23 in FIG. 2, but as a matter of course, the other conductors 23 (six conductors in the drawing) are also formed by a plurality of alloy wires 23*b* twisted with a plurality of annealed copper wires 23*a*.

In the flexible cable 1 according to the present embodiment described above, a plurality of alloy wires 23*b* are twisted as reinforcing wires with a plurality of annealed copper wires 23*a* to form the conductor 23, and the conductor 23 is multi-twisted to form the assembled conductor 21. This assembled conductor 21 is covered with the insulator 22 to form the insulated wire core 20. This insulated wire core 20 is multi-twisted to form the cable core portion 2. Thus, a flexible cable superior in durability and flexibility can be provided.

It is noted that the aforementioned embodiment is merely illustrative and various changes in design can be made. For example, the flexible cable in which the outside of the cable core portion 2 is covered with the sheath 4 via the static electromagnetic shielding layer 3 is illustrated in the present embodiment. However, the outside of the cable core portion 2 can be covered with the sheath 4 not via the static electromagnetic shielding layer 3. Further, the flexible cable is not limited to the circular shape, and can be formed in a rectangular shape as shown in FIG. 3.

Figure 3:
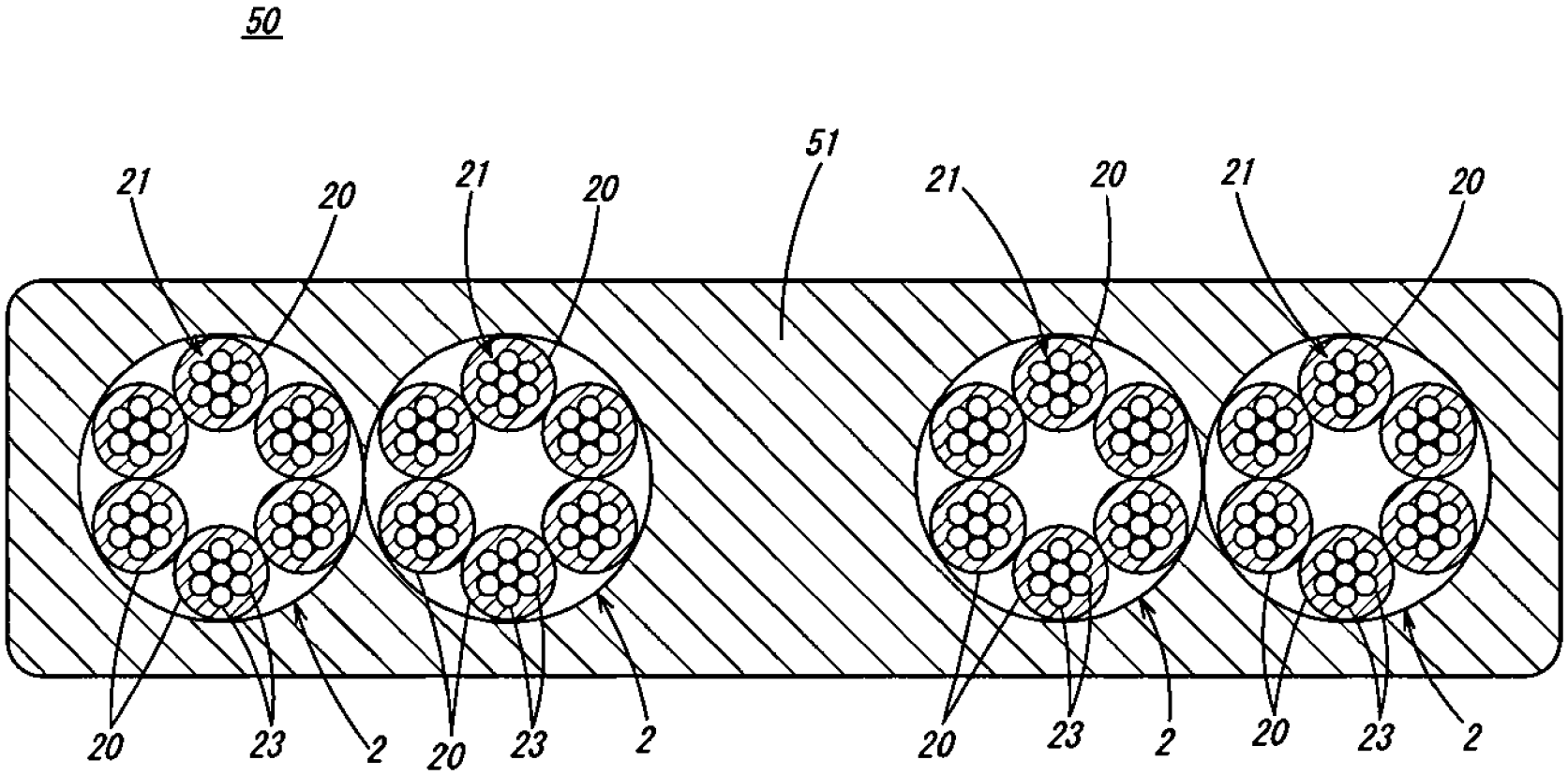
FIG. 3 is a sectional view of a flexible cable according to another embodiment of the present invention.

More specifically, as shown in FIG. 3, a flexible cable 50 is formed in a rectangular shape by arranging a plurality of cable core portions 2 (four core portions in the drawing) in parallel, and covering the outside of the plurality of parallelly arranged cable core portions 2 with a rectangular sheath 51 made of flexible vinyl or urethane materials. The same effect as the foregoing circular flexible cable can be obtained even by such rectangular flexible cable.

Next, the present invention will be described in more detail using examples and a comparative example.

Example 1

Figure 2:
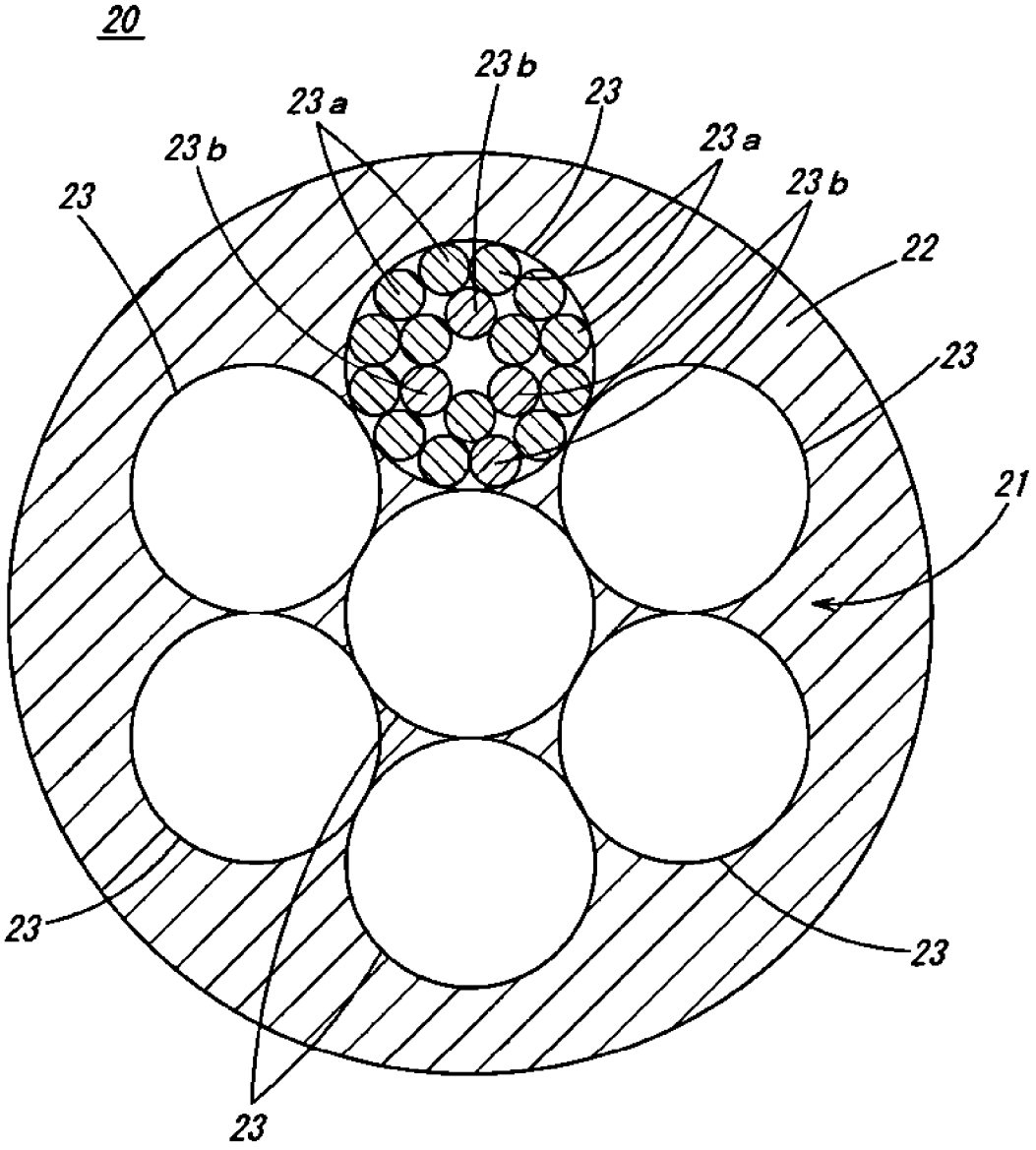
FIG. 2 is a sectional view of an assembled conductor according to the same embodiment.

As Example 1, an assembled conductor 21 generally as shown in FIG. 2 was prepared. The assembled conductor 21 was prepared by twisting seven conductors 23. The conductor 23 was made by twisting eight annealed copper wires 23*a* with a diameter of 80 μm and two copper alloy wires with a diameter of 80 μm as the alloy wires 23*b*. As for the copper alloy wire, a tin-bearing copper alloy wire containing 0.20 to 0.40 mass % of tin was used.

Example 2

Similar to Example 1, as an Example 2, an assembled conductor 21 generally as shown in FIG. 2 was prepared. The assembled conductor 21 was prepared by twisting seven conductors 23. The conductor 23 was prepared by twisting seven annealed copper wires 23*a* with a diameter of 80 μm and three copper alloy wires with a diameter of 80 μm as the alloy wires 23*b*. As for the copper alloy wire, a tin-bearing copper alloy wire containing 0.20 to 0.40 mass % of tin was used.

Example 3

Similar to Example 1, as an Example 3, an assembled conductor 21 as generally shown in FIG. 2 was prepared. The assembled conductor 21 was made by twisting seven conductors 23. The conductor 23 was made by twisting five annealed copper wires 23*a* with a diameter of 80 μm and five copper alloy wires with a diameter of 80 μm as the alloy wires 23*b*. As for the copper alloy wire, a tin-bearing copper alloy wire containing 0.20 to 0.40 mass % of tin was used.

Comparative Example 1

Similar to Example 1, as a Comparative Example 1, an assembled conductor 21 as generally shown in FIG. 2 was made. The assembled conductor 21 was prepared by twisting seven conductors 23. The conductor 23 was prepared by twisting ten annealed copper wires 23*a* with a diameter of 80 μm.

The assembled conductors of Examples 1 to 3 and Comparative Example 1 having been made in the foregoing manner were used to conduct a test by applying a 200 g load with a bending radius of 10 mm and bending at 90-degree left and right angles, which was counted as one time, and determining the number of times the cable can bend before it breaks. In addition, conductivity per conductor in the assembled conductor 21 was measured. These results will be shown in Table 1, wherein the number of times of the foregoing bending which lead to breaking is denoted as the number of repetitive bendings in Table 1.

TABLE 1

| | Mixing proportion of copper alloy wire (%) | Conductivity per conductor (%) | The number of repetitive bendings (times) |
|---|---|---|---|
| Example 1 | 20 | 93 | 21,263 |
| Example 2 | 30 | 91 | 24,891 |
| Example 3 | 50 | 85 | 32,724 |
| Comparative Example 1 | 0 | 98 | 13,333 |

From the above Table 1, it can be seen that the number of repetitive bendings of Examples 1 to 3 are much more than that of Comparative Example 1 (Example 1 and Example 2 are about twice the number of Comparative Example 1, and Example 3 is about two and a half times the number of Comparative Example 1). Therefore, it can be seen that Examples 1 to 3 can be bent at 90-degree left and right angles, and moreover, superior in durability as compared with Comparative Example 1. Further, in Example 3, conductivity per conductor is 85% even if the mixing proportion of the alloy wire 23*b* composed of the copper alloy wire is 50%. Thus, this is conductivity capable of securing conductivity adequately resistant to use.

Accordingly, as a result of the above test results, a recommended mixing proportion of the alloy wire 23*b* composed of the copper alloy wire in the conductor 23 will be given. Considering the number of repetitive bendings (durability) and conductivity, the mixing proportion of the copper alloy wire in the conductor 23 is preferably 10 to 70%. Consequently, a flexible cable more superior in durability and flexibility can be provided, and at the same time, conductivity resistant to use can be secured.

What is claimed is:

1. A flexible cable comprising:

a conductor formed by twisting a plurality of annealed copper wires and a plurality of alloy wires;

an assembled conductor formed by twisting a plurality of the conductors;

an insulated wire core formed by covering the assembled conductor with an insulator;

a cable core portion formed by twisting a plurality of the insulated wire cores; and a sheath covering the outside of a single or a plurality of the cable core portions;

wherein the alloy wires comprise copper alloy wires, and a proportion of the copper alloy wires in the conductor is 10 to 70%.

2. A flexible cable comprising:

a sheath covering the outside of a first cable core portion;

the first cable core portion comprising a plurality of insulated wire cores twisted together;

at least one of the plurality of insulated wire cores comprising an assembled conductor covered by an insulator;

the assembled conductor comprising a plurality of conductors twisted together; and at least one of the plurality of conductors comprising a plurality of annealed copper wires and a plurality of alloy wires twisted together;

wherein the alloy wires comprise copper alloy wires, and a proportion of the copper alloy wires in the conductor is 10 to 70%.

3. The flexible cable according to claim 2, further comprising:

a second cable core portion constructed in accordance with the first cable core portion; and the sheath covering the outside of the second cable core portion.

4. A flexible cable comprising:

a plurality of conductors, each conductor comprising a plurality of annealed copper wires and a plurality of alloy wires twisted together;

a plurality of assembled conductors, each assembled conductor comprising a plurality of the conductors twisted together;

a plurality of insulated wire cores, each insulated wire core comprising one of the plurality of assembled conductors covered with an insulator;

a first cable core portion comprising a plurality of the insulated wire cores twisted together; and a sheath covering the outside of the first cable core portion;

wherein the plurality of alloy wires of each conductor comprise copper alloy wires, and a proportion of the copper alloy wires in each conductor is 10 to 70%.

5. The flexible cable according to claim 4, further comprising:

a second cable core portion constructed according to the first cable core portion; and the sheath covering the outside of the second cable core portion.

* * * * *